US005882582A

United States Patent [19]

Comarteau et al.

[11] Patent Number: 5,882,582

[45] Date of Patent: Mar. 16, 1999

[54] LIQUID METAL HEATING AND CASTING LADLE

[75] Inventors: Jean-Louis Comarteau, Chatenoy-le-Royal; Alain Remy, Chalon-sur-Saone, both of France; Dieter Schluckebier, Simmerath-Lammersdorf, Germany

[73] Assignees: Seva Chalon-Sur-Saone, France; Otter Junker GmbH, Simmerath, Germany

[21] Appl. No.: 836,523

[22] PCT Filed: Oct. 30, 1995

[86] PCT No.: PCT/FR95/01433

§ 371 Date: Jul. 9, 1997

§ 102(e) Date: Jul. 9, 1997

[87] PCT Pub. No.: WO96/13349

PCT Pub. Date: May 9, 1996

[30] Foreign Application Priority Data

Oct. 31, 1994 [FR] France ..... 94 13155

[51] Int. Cl.[6] ..... B22D 41/01

[52] U.S. Cl. ..... 266/242; 266/231

[58] Field of Search ..... 266/200, 242, 266/234; 432/248

[56] References Cited

U.S. PATENT DOCUMENTS

| | | | |
|---|---|---|---|
| 3,790,145 | 2/1974 | Gering | 266/234 |
| 3,918,692 | 11/1975 | Oberg | 266/234 |
| 4,638,980 | 1/1987 | Beele | 266/242 |

FOREIGN PATENT DOCUMENTS

| | | |
|---|---|---|
| 1359528 | 8/1964 | France . |
| 2364719 | 4/1978 | France . |
| 748059 | 10/1944 | Germany . |
| 1281121 | 10/1968 | Germany . |

*Primary Examiner*—Scott Kastler

*Attorney, Agent, or Firm*—Sughrue, Mion, Zinn, MacPeak & Seas, PLLC

[57] ABSTRACT

A ladle (1) comprising a main portion (5), an outlet (3) and an inductor assembly (2) fitted onto the main portion. The main portion comprises a cavity (13) defined by a refractory lining, provided with at least one opening (21) and shaped so that no pockets of molten metal remain after pouring. Consequently, the metal flows more readily, and hot deslagging and metal temperature measurement are made easier. The ladle is useful for maintaining the temperature of high melting point metals such as steel or superalloys for processes requiring metal sampling.

14 Claims, 1 Drawing Sheet

LIQUID METAL HEATING AND CASTING LADLE

BACKGROUND OF THE INVENTION

The present invention concerns a furnace or heating ladle for holding of liquid metals, in particular metals having a high melting point, such as cast irons, steels, or superalloys.

In particular, the invention relates to ladles of the type comprising a main element incorporating a cavity delimited by a heat-resistant lining and intended to be filled with molten metal, this cavity being fitted with a filling opening and a metal-outlet orifice connecting with said cavity, and metal-heating means. The cavity is intended to be filled with molten metal whose temperature is kept constant.

Conventional practice entails keeping liquid metal at constant temperature by using an electric tunnel furnace (see, for example, U.S. Pat. No. 3,810,564).

In this type of furnace, the holding the metal at constant temperature is effected by circulating the metal in a duct heated by an inductor. It is difficult to implement this technique when dealing with metals which require high holding temperatures, such as steels and superalloys. When in use, this type of furnace exhibits problems relating to the strength of the heat-resistant material composing the tunnel.

With some alloys such as treated cast irons, malfunctions occur, in particular those caused by substance build-up.

Furthermore, in tunnel furnaces, the quantities of refractory are significant, thereby mandating that a heel or the furnace be left continuously at constant temperature; accordingly, the use of the tunnel furnace is limited to a small number of applications not requiring a high degree of flexibility of use. For example, it is difficult to change alloys frequently or to shut down the furnace face every day.

SUMMARY OF THE INVENTION

Given this state of the art, the invtention proposes to furnish a furnace or heating ladle designed to hold liquid metal and to solve all of the problems mentioned above. In particular, the invention is intended to supply a heating ladle whose design facilitates the flow of liquid metal, especially during liquid metal-drawing operations and all subsequent measuring, cleaning, and maintenance operations.

To this end, the invention concerns a ladle of the aforementioned type, characterized by the fact that said cavity incorporates a heel zone and a reserve zone, the volume of the heel zone is less than the volume of reserve zone, and the heel zone is located in the lower portion of a main cylinder having axis Y—Y which slopes at an angle of approximately 30° in the functional position of the ladle, the shape of said cavity incorporating no dead angle, thereby producing an even flow of the liquid metal and allowing access, through said filling opening, to each point of the cavity, in particular for the purpose of heat-cleaning the casting ladle.

In accordance with other features of the casting ladle:

said cavity incorporates a filling cylinder ending in said filling opening, and the liquid metal reserve zone connecting with this cylinder, the feed cylinder, and the outlet orifice;

the axes of said cylinders are parallel in a vertical plane, the filling cylinder having its axis displaced upward in relation to the axis of the main cylinder;

the filling cylinder has a diameter greater than the diameter of the main cylinder, so as to constitute the liquid metal reserve zone, said reserve zone being connected to the feed cylinder by a connection zone substantially truncated in shape and fitted with rounded segments;

the axes of cylinders falling within a vertical plane slope upward toward the filling opening at an angle of approximately 30° in the functional position of the ladle, in order to ensure that the ladle can hold a large quantity of liquid metal, while minimizing the heel.

The filling opening comprises a sealing device intended to limit heat losses from the metal and/or to render the metal surface inert.

said heating means comprise an inductor which surrounds the cylindrical heating area having the same axis and preferably the same diameter as the feed cylinder, and they are mounted removably on the main element.

BRIEF DESCRIPTION OF THE INVENTION

The features and advantages of the invention will emerge from the following description, which is provided as an example in conjunction with the attached drawing, which represents a diagram in vertical cross-section of the equipment incorporating the constant temperature holding ladle according to the invention.

DETAILED DESCRIPTION OF THE INVENTION

Figure 1:
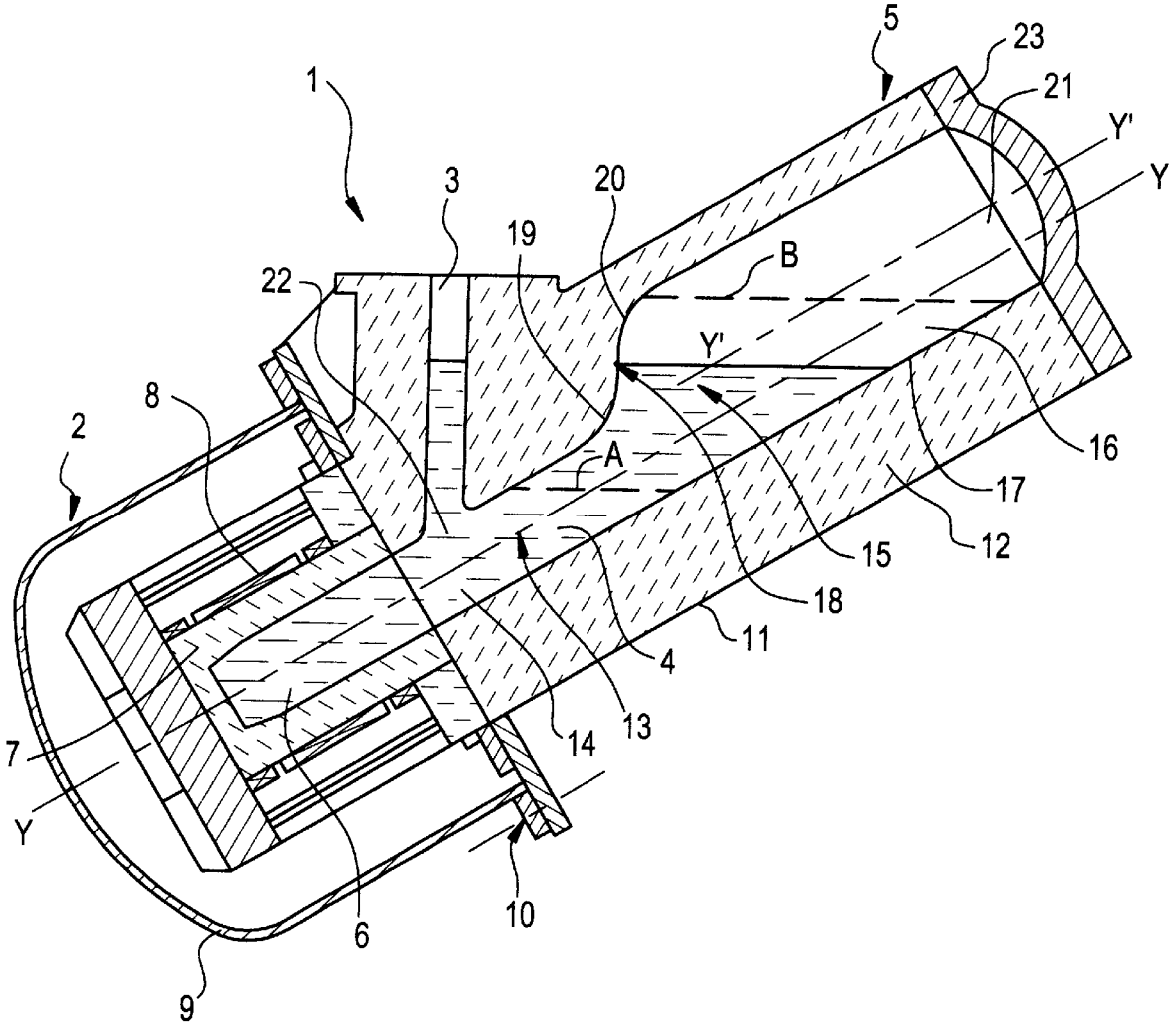

The equipment shown comprises a heating ladle 1 incorporating three sub-assemblies: a liquid metal-heating unit, shown in the form of an inductor unit 2; an outlet orifice 3 for the metal 4, and a main element 5. The inductor unit 2 keeps the metal at a given temperature.

The inductor unit 2 encloses a heating zone 6 shaped like a deep bowl delimited by a heat-resistant sheathing 7. his heat-resistant sheathing 7 is enclosed by a medium-frequency induction coil 8 designed to heat the liquid metal 4 by induction, the entire unit being housed in a frame element 9. The inductor unit 2 also comprises means for attachment to the main element 5, these being any suitable means available to those skilled in the art, in particular a flange-and-bolt system 10.

The main element 5 of the ladle comprises a casing 11 in which a lining 12 made of a high-resistant material is arranged. A cavity 13 made up of several geometric volumes and incorporating at least one opening is formed inside this lining 12.

The heating zone 6 of the inductor unit 2 is also cylindrical, of the same diameter as the main cylinder 14 of the main element 5, and, like the latter, slopes upward at an angle to the horizontal so as to delineate a shared axis Y—Y. In the embodiment of the invention illustrated, this angle is approximately 30°, and the diameter of the heating area 6 and of the main cylinder 14 is 225 mm.

The interior cavity 13 of the main element 5 comprises a third volume made up of a reserve zone 15 for liquid metal 4. This reserve zone 15 forms the downward extension of a filling cylinder 16 having axis Y'—Y' parallel to an axis Y—Y shared by the heating zone 6 and the main cylinder 14. The axis Y'—Y' of the filling cylinder 16 is therefore parallel in a vertical plane and shifted upward in relation to the axis Y—Y, and the filling cylinder 16 has a diameter substantially larger than the diameter of the main cylinder 14. The main cylinder 14 and the filling cylinder 16 are arranged in such away as to have a common lower generating line 17. Furthermore, the upper parts of the two cylinders 14 and 16 are connected by an attachment zone 18. This attachment zone 18 is substantially truncated in shape and fitted with rounded segments 19, 20 which form a sequential junction between the two cylinders 14, 16. The cylinders 14, 16 may incorporate a slight clearance angle directed toward the filling opening 21, so as allow ease of manufacture of the main element 5 and of the reserve area 15 thereof, by molding a heat-resistant material around a core.

If a diameter of approximately 550 mm is selected for the reserve area and a diameter of 225 mm and a length of 100 mm for the outlet orifice 3, the usable capacity of the constant temperature holding ladle 1, which corresponds to the volume of the cavity located between a lower point of reference A adjoining the lower end 22 of the outlet orifice 3 and an upper point of reference B corresponding to the maximum fill level of the ladle, is approximately 550 kg of alloy having a density of approximately 7. Of course, to adapt this usable capacity for use in other casting equipment, it is necessary only to change the dimensions of the components of the ladle 1.

With respect to this capacity, a current having a frequency of 500 Hz generated by a 250 KW power source is fed through the induction coil 8, so as to produce a uniform temperature in all of the liquid metal 4, without producing excessive agitation which would be harmful to the strength of the refractory.

The filling opening 21 of the filling cylinder 16 is closed, during use of the ladle 11, by a filling gate 23 fastened detachably and impermeably to the casing 1.

By means of the geometry specified above, it is possible to gain access, through the filling opening 21, to any point in the reserve zone 15 of the cavity 13. Furthermore, the distance between the reserve zone 15 holding the metal 4 and the heating zone 6 is kept to a minimum, thereby ensuring more even heating of the liquid metal because of a proximity effect.

When in use, the ladle 1 according to the invention functions in the following way: beginning with a clean ladle without deposits, the filling gate 23 is opened and the internal cavity 13 of the main element is filled with liquid metal 4 until this metal reaches the level indicated by the point of reference B. Through the opening 21, any impurities that may be present on the surface of the metal are skimmed off, and the temperature of the metal is measured. Next, the filling gate 23 is impermeably sealed.

Then, metal is drawn off by causing the ladle 1 to rotate around the axis Y—Y. Gradual rotation of the ladle 1 causes the liquid metal 4 to flow out through the orifice 3.

After a predetermined period, the ladle is returned to its initial position.

The ladle may also be used by putting in place pressurization means through the cover 23 or the casing 11 and the lining 12.

These pressurization means make it possible to draw off liquid metal through the outlet orifice 3 without having to rotate the ladle. This type of device may be used to pour casts by gravity, the use of pressure making it possible to control with precision the uniform tapping of the liquid metal.

After a certain number of tapping operations, the liquid metal level in the reserve zone 15 of the main element 5 falls to the lower level A. At this juncture, the ladle 1 is filled as previously indicated, or the casting run is stopped.

It emerges from the foregoing description that the constant temperature holding ladle 1 according to the invention meets the objectives set for it, by virtue of the special shape and arrangement of the components of the reserve zone 15 of the main element 5, in conjunction with the shape and configuration of the opening 21 of the main element 5. Because of the coaxial or parallel configuration of the heating zone 6, of the main cylinder 14, and of the filling cylinder 6, this shape is specially adapted for metal casting and for the cleaning, measurements, and maintenance of the ladle 1.

Furthermore, in order to maintain the temperature of the metal and to stir it calmly and evenly, the induction coil 8 is fed with a medium- or low-frequency current, in particular one of 50 to 1,500 Hertz.

To avoid thermal shocks to the heat-resistant lining 12 and/or to avoid solidifying the liquid metal when the ladle 1 is filled, the ladle must be preheated prior to filling. Preheating is effected by means of a burner powered by oxygen and natural gas, which is positioned at the filling opening 21. The presence of the outlet orifice 3 makes it possible to drain away the combustion products. In particular in the absence of outlet discharge, the steam given off by this type of burner can produce dissolved gases (e.g., hydrogen) in the metal. These dissolved gases pose a number of metallurgical problems, such as blistering, porosity, inclusions, and even the fragility of the products made of the metal. As a consequence, draining away the steam by means of the device according to the invention solves these problems.

We claim:

1. Ladle (1) designed to hold metal (4) at constant temperature, comprising a main element (5) incorporating a cavity (13) delimited by a heat-resistant lining (12) and designed to be filled with molten metal, said cavity incorporating at least one filling opening (21), a metal-outlet orifice (3) connecting with said cavity, and metal-heating means (2), wherein said cavity (13) comprises a heel zone and a reserve zone (15), the volume of the heel zone being less than the volume of the reserve zone, said cavity (13) incorporating a shape wherein a straight line can be drawn through the cavity (13) from any point within the cavity to the opening (21) so as to exclude dead angles thereby promoting the displacement of the liquid metal (4) and allowing access to every point of the cavity through said filling opening (21) in the reserve zone (15), in order to heat-clean the ladle (1).

2. Ladle (1) according to claim 1, wherein said cavity (13) comprises a filling cylinder (16) ending in said filling opening (21), and the liquid metal reserve zone (15) connecting with said filling cylinder (16), with a main cylinder (14), and with the outlet orifice (3).

3. Ladle (1) according to claim 2, wherein said main and filling cylinders (14, 16) have parallel axes (Y—Y, Y'—Y'), the axis (Y'—Y') of the filling cylinder (16) being offset upward in relation to the axis (Y—Y) of the main cylinder (14).

4. Ladle (1) designed to hold metal (4) at constant temperature, comprising a main element (5) incorporating a cavity (13) delimited by a heat-resistant lining (12) and designed to be filled with molten metal, said cavity incorporating at least one filling opening (21), a metal-outlet orifice (3) connected with said cavity, and metal-heating means (2), wherein said cavity (13) comprises a heel zone and a reserve zone (15), the volume of the heel zone being less than the volume of the reserve zone, said cavity (13) incorporating a shape which excludes dead angles so as to promote the displacement of the liquid metal (4) and allowing access to every point of the cavity through said filling opening (21) which is incorporated in the reserve zone (15), in order to heat-clean the ladle (1), wherein:

said cavity (13) comprises a filling cylinder (16) ending in said filling opening (21), and the liquid metal reserve zone (15) is connected with said filling cylinder (16), with a main cylinder (14), and with the outlet orifice (3);

said main and filling cylinders (14,16) have parallel axes (Y—Y, Y'—Y'), the axis (Y'—Y') of the filling cylinder (16) being offset upward in relation to the axis (Y—Y) of the main cylinder (14); and the filling cylinder (16) has a diameter greater than the diameter of the main cylinder (14) so as to form the liquid metal reserve zone (15), said reserve zone (15) being connected to the main cylinder (14) by a connection zone (18) having a substantially truncated shape incorporating rounded segments (19,20).

5. Ladle (1) according to claim 3, wherein the axes (Y—Y, Y'—Y') of the main and filling cylinders (14, 16), which fall within one vertical plane, slope upward toward the inlet opening (21).

6. Ladle (1) according to claim 1, wherein said ladle comprises a sealing device (23) designed to limit thermal losses from the metal and to render the metal surface inert.

7. Ladle (1) designed to hold metal (4) at constant temperature, comprising a main element (5) incorporating a cavity (13) delimited by a heat-resistant lining (12) and designed to be filled with molten metal, said cavity incorporating at least one filling opening (21), a metal-outlet orifice (3) connected with said cavity, and metal-heating means (2), wherein said cavity (13) comprises a heel zone and a reserve zone (15), the volume of the heel zone being less than the volume of the reserve zone, said cavity (13) incorporating a shape which excludes dead angles so as to promote the displacement of the liquid metal (4) and allowing access to every point of the cavity through said filling opening (21) which is incorporated in the reserve zone (15), in order to heat-clean the ladle (1), wherein:

said cavity (13) comprises a filling cylinder (16) ending in said filling opening (21), and the liquid metal reserve zone (15) is connected with said filling cylinder (16), with a main cylinder (14), and with the outlet orifice (3); and said heating means (2) comprise an induction coil (8) surrounding a cylindrical heating zone (6) having the same axis (Y—Y), and the same diameter, as the main cylinder (14), and said heating means are mounted detachably on the main element (5).

8. A method of casting using a ladle according to claim 1, comprising the steps of feeding a medium or low frequency current of 50 to 1,500 hertz through an induction coil (8) in order to keep the temperature of the metal (4) constant by stirring it calmly and evenly.

9. A method of casting using a ladle according to claim 1, comprising the steps of using a preheating burner positioned at the filling opening (21) to preheat the ladle, and draining away the combustion products through the outlet orifice (3).

10. A method of casting according to claim 9, wherein the step of using a preheating burner further comprises using a preheating burner which operates on oxygen and natural gas.

11. Ladle (1) according to claim 2, wherein said filling cylinder (16) and said main cylinder (14) are arranged in an end-to-end relationship.

12. Ladle according to claim 3, wherein said filling cylinder (16) and said main cylinder (14) are arranged in end-to-end relationship.

13. Ladle (1) according to claim 6, wherein said sealing device (23) is connected to said feed cylinder (16).

14. Ladle (1) according to claim 7, wherein said cylindrical heating zone (6) and said main cylinder (14) are arranged in an end-to-end relationship.

* * * * *